US006825604B2

(12) United States Patent
Ozawa

(10) Patent No.: US 6,825,604 B2
(45) Date of Patent: Nov. 30, 2004

(54) PHOSPHOR SCREEN AND CATHODOLUMINESCENT DEVICE HAVING THE SAME

(75) Inventor: Lyuji Ozawa, New York, NY (US)

(73) Assignee: Kabushiki Kaisha Kakuma, Nagano (JP)

( * ) Notice: Subject to any disclaimer, the term of this patent is extended or adjusted under 35 U.S.C. 154(b) by 24 days.

(21) Appl. No.: 10/428,943

(22) Filed: May 5, 2003

(65) Prior Publication Data

US 2003/0230966 A1 Dec. 18, 2003

(30) Foreign Application Priority Data

Jun. 13, 2002 (JP) ..... 2002-173264

(51) Int. Cl.[7] ..... H01J 1/34
(52) U.S. Cl. ..... 313/461; 313/463; 313/466
(58) Field of Search ..... 313/461, 463, 313/466

(56) References Cited

U.S. PATENT DOCUMENTS 5,012,155 A * 4/1991 Datta et al. ..... 313/461
5,477,105 A * 12/1995 Curtin et al. ..... 313/422
6,713,953 B1 * 3/2004 Sung et al. ..... 313/495

OTHER PUBLICATIONS

Ozawa, Lyuji. Journal of Materials Chemistry and Physics. vol. 73, pp. 144–150, 2002.

"Cathodoluminescence Theory and Applications," Kodansha, 1990, Chapter 7.1.5, pp. 116–117.

* cited by examiner

*Primary Examiner*—Ashok Patel
(74) *Attorney, Agent, or Firm*—Birch, Stewart, Kolasch & Birch, LLP

(57) ABSTRACT

The phosphor screen is capable of minimizing the spread of lights in the phosphor screen, so as to restrict fading images and lowering contrast. The phosphor screen comprises a lot of minute phosphor sections. The phosphor sections are respectively enclosed by barriers, which absorb visible lights and have electric conductance, and whose height is equal to or higher than a half of thickness of the phosphor sections. The barriers are made of a material including the particles of an inorganic compound, whose average diameter is 1–8 μm, and carbon particles, whose average diameter is less than 1 μm.

8 Claims, 3 Drawing Sheets

PHOSPHOR SCREEN AND CATHODOLUMINESCENT DEVICE HAVING THE SAME

This nonprovisional application claims priority under 35 U.S.C. 517 119(a) on Patent Application No(s). 2002-173264 filed in JAPAN on Jun. 13, 2002, which is(are) herein incorporated by reference.

BACKGROUND OF THE INVENTION

The present invention relates to a phosphor screen, which displays video images and characters, and a cathodoluminescence having said phosphor screen, more precisely relates to a phosphor screen capable of preventing lights from scattering among neighbor phosphor sections.

Cathodoluminescences are widely used as television receivers, display devices of computers, etc. A cathode ray tube (CRT) is an example of the cathodoluminescences. The CRT basically comprises, an anode, an electron gun, a phosphor screen and an aluminum film on the phosphor screen. A theory of the CRT will be explained. Electrons extracted form the cathode are sharply focused by electrodes of the electron gun, and a focused electron beam irradiates the phosphor screen formed on the faceplate. The irradiated phosphor screen converts energy of the invisible electron beam into visible lights. In a color CRT, a shadow mask is provided with a proper distance away from a surface of a color phosphor screen, electron beams from three electron guns pass through holes of the shadow mask and irradiate phosphor sections, which correspond to the electron beams, so that the phosphor sections emit three color lights respectively.

The lights emitted by the phosphor screen go toward an inner part of the CRT, too. By forming an aluminum reflection film on the phosphor screen, all lights emitted by the phosphor screen go toward a viewer, so that brightness of the phosphor screen observed by the viewer can be double. By coating inner faces of a funnel and a neck tube with an electrically conductive material having proper thickness and by inputting anode voltage to the electric conductive film and the aluminum film on the phosphor screen, an inside space of the CRT, which has large capacity, has a uniform electric field. The electron beam from the electron gun travels in the uniform electric field of the CRT with constant sped, which is determined by anode potential. The electron beam moving in the inside space of the CRT at constant speed is deflected by a magnetic coil, which is installed outside of the CRT, and the deflected electron beam scans on entire phosphor screen from left to right and up to down. By scanning the electron beam, tiny spots in the phosphor screen sequentially emits cathodoluminescence lights; the viewer perceives uniformly emitting screen with after image effect of the eyes. Since the scanning electron beam is deflected to sequentially irradiate the tiny spots in the phosphor screen, the CRT must have a large vacuum space and a thick glass envelope, which can withstand the vacuum therein.

When the electron beam scanning the phosphor screen of the CRT is modulated with video signals, brightness of lighting spots on the phosphor screen synchronously vary with the video signals, so that video images are shown on the phosphor screen. Since the electron beam irradiating the phosphor screen has a highly concentrated energy, e.g., 4 $KW/cm^2$, the number of $10^{20}$ photons/($cm^2$, second) are emitted from the phosphor screen, so that the phosphor screen emits lights with the brightness of 15,000 $cd/m^2$.

Images on the phosphor screen in the CRT are shown with high brightness, without rise of temperature of the phosphor screen, that is a great advantage of the CRT. The CRT capable of showing highly bright images is superior to other display devices. Since the CRTs are suitable for showing digital video images, they will be used for screen units of digital television receivers.

FIG. 1 is a partial sectional view of a conventional phosphor screen of a monochrome CRT.

A display section 10 of the CRT comprises: a glass plate 11 which acts as a faceplate; a phosphor screen 12 which is formed on the faceplate 11 and made of phosphor particles 12*z*; and an aluminum film 13. An electron beam 14 is irradiated from an electron gun (not shown). Lights 15 emitted from the phosphor particles 12*z*, which are irradiated by the electron beam 14, are scattered. Resolution of images shown on the display section 10 depends on diameter of the electron beam 14. In the CRT, the electron beams 14 from the electron gun (not shown) makes the phosphor particles 12*z* emit lights so as to show images on the phosphor screen. The phosphor particles 12*z*, to which the electron beam 14 irradiates, emit the scattered lights 15, so that a viewer feels as if the neighbor phosphor particles 12*z* too emit lights in spite of emitting no lights. Namely, the scattered lights 15 irradiate the phosphor particles 12*z*, which is irradiated by no electron beam. Therefore, contrast and sharpness of images on the phosphor screen are badly influenced.

FIG. 2 is a partial sectional view of a conventional phosphor screen of a color CRT. A display section 10*a* of the color CRT comprises: the faceplate 11; the phosphor screen 12 which is formed on the faceplate 11 and made of phosphor particles 12*z*; and the aluminum film 13, as well as the monochrome CRT. Unlike the monochrome CRT, the phosphor screen 12 includes a lot of minute phosphor sections 12*d*, which irradiate different colors respectively and which are arranged on the faceplate 11 with prescribed separations. A black matrix film 16 is provided between the adjacent phosphor sections 12*d*. Ordinary thickness of the black matrices 16 is 1 $\mu$m or less and thinner than that of the phosphor screen 12; the scattered lights 15 from one phosphor section 12*d* go into the neighbor phosphor sections 12*d*. Since the black matrices 16 are coated with no phosphor particles 12*z* or partially coated therewith, a large space exists between the aluminum film 13 and the phosphor screen 12. The large space makes a range of scatter lights 15 long, so that the scattered lights 15 irradiate the neighbor phosphor sections 12*d*. Influence of the scattered lights 15 is greater in the color phosphor screen than in the monochrome phosphor screen. Therefore, the images shown on the phosphor screen 12 is whitened by increasing brightness, so that the images cannot be shown with pure colors.

In the color CRT, a plurality of layers of crystallized phosphor particles, whose diameter is about 3 $\mu$m, are piled so as to increase the brightness. Since the diameter of the electron beam is about 500 $\mu$m, which is much greater than that of the phosphor particles, the resolution of images on the phosphor screen is basically determined with the diameter of the electron beam irradiating the phosphor screen. Electron guns, which focus the electron beam to desired resolution on the phosphor screen, have well established, and they can show images on the phosphor screen with high resolution.

Since images on display devices are watched by human eyes, they should not irritate the eyes. Irritation of the eyes relates with quality of images and brightness thereof. To comfortably watch images on display devices for a long time, the screen brightness should be properly adjusted so as not to damage the eyes. The eyes have two kinds of light sensors, depending on light intensities: one responds on ordinary light intensities (photopic vision); and the other responds on dark light intensities (scotopic vision). Images on display devices are made with the high intensities of lights, so that the viewer observes the images with the photopic vision. The human eyes have a very wide field of vision; the viewer usually observes the images on the display device against a background of a room including furniture. If the room is made light to watch the background of the room with the photopic vision, the eyes will be comfortable to watch the images and the background, with the photopic vision, for a long time. If there is a difference in brightness between the images and the background, the two sensors in the eyes simultaneously are used for watching; the images with the photopic vision and the background with the scotopic vision. Namely, the eyes do not properly adjust the unbalanced light intensities; the unadjusted eyes are damaged with watching the images for a long time.

If the brightness of the images are much greater than that of the background, the eyes can comfortably watch the images with the photopic vision. Rooms are usually illuminated with around 1,500 lux. The brightness of furniture in illuminated rooms is around 150 cd/cm$^2$. If the viewer watches images on the screen of the display device with around 25 cm apart therefrom, which is a distance of distinct vision, preferable screen brightness is around 170–200 cd/m$^2$. Under that condition, the viewer can watch the images on the screen and the furniture, etc. with the photopic vision without damaging his or her eyes. On the other hand, if the furniture is in a dark room, the images are watched with the photopic vision; the background is simultaneously watched with the scotopic vision. Therefore, watching of images in dark rooms for a long time will result in damage of the eyes. Preferable screen brightness, which do not damage eyes, depends on a distance between the screen and the viewer, and it will be greater than the brightness of the distance of distinct vision if the distance between the screen and the viewer is made longer. The CRTs only hold the preferable or required screen brightness, e.g., 200 cd/m$^2$ or more, for 10,000 hours or more.

With said high screen brightness, however, the CRTs have a serious problem. Namely, images on the screen at the distance of distinct vision exhibit considerable flicker which is fluctuation of light intensities of both large and small images on the screen. When the distance between the screen and the viewer is longer than that of distinct vision, the flicker is not visible. However, human eyes are highly sensitive to minute motion of images and variation of brightness; the viewer's eyes detect small flicker of images and flicker of the phosphor screen without reference to images, even if the viewer cannot clearly recognize the flicker. Signals of detecting the flicker are transmitted from the eyes to brain. By unconsciously detecting the flicker for a long time, the eyes are damaged, so that eye diseases, e.g., astigmatism, or headache will be caused. Therefore, the flicker must be removed. According to experiments, the flicker of CRTs is suppressed by reducing the screen brightness. In the HDTV (High Definition TV), the brightness of the phosphor screen is made lower so as to avoid the problems of flicker. In some cases, watching a television installed in a dark room will cause eye diseases, e.g., astigmatism, amblyopia, or headache. CRTs, which is capable of showing images having required brightness without flicker, is required now.

According to the published article in Journal of Materials Chemistry and Physics (volume 73, page 144–150, 2002), it has been revealed that flicker on phosphor screens are caused with staying of secondary electrons, which are inevitably emitted from phosphor particles by irradiation of an electron beam. By coating a transparent electric conductive film of a faceplate with three layers of phosphor screens and inputting anode voltage to the transparent electric conductive film, the phosphor articles of the phosphor screens are in a strong anode field, so that the secondary electrons can be removed from the phosphor screens. By removing the secondary electrons, flicker can be disappeared from screens of CRTs which show images with required screen brightness.

In the conventional CRTs, the phosphor screen directly coats the faceplate, which is made of an electrically insulating material, e.g. glass. An anode is a carbon film formed on an inner face of a funnel and perpendicularly arranged with respect to the faceplate. Therefore, only the phosphor particles arranged at a fringe of the phosphor screen are influenced with the strong anode field; the phosphor particles in a large area of the phosphor screen are influenced with a weak anode field. When a small number of the secondary electrons electrically float around surfaces of the phosphor particles, they can be collected by the anode. By collecting the secondary electrons, movement of large electron cloud, which is a crowd of the secondary electrons, will be observed as large flicker of the screen. On the other hand, movement of small electron cloud will be observed as small flicker of images. Scale of the flicker is determined by conditions of irradiating electron beams to the phosphor screen. By increasing power of the electron beam, the scale of the flicker is made larger.

Phosphor screens, which overcome the problems of flicker, have following disadvantages: low sharpness and low contrast of images; and whitening images in color CRTs. If the brightness of the phosphor screen is high, edges or outlines of images on the phosphor screen are indistinct, further other parts of the phosphor screen, to which no electron beam irradiates, are made brighter. As a result, background brightness of the entire phosphor screen increases to unacceptable level. Contrast of images, which is ratio of light intensity of image to light intensity of background, becomes to a low level. Especially, in color CRTs, color images are whitened as a result of contamination from neighbor phosphor sections in different color. Namely, pure color images cannot be shown with high brightness. Thus, to improve contrast of images, the brightness of the phosphor screen is low. These days, CRTs, which have high resolution and low brightness, have been provided so as to show high contrast images. However, as described above, the problems of eye diseases, etc., which are caused by watching images of low brightness, have never been solved. Namely, CRTs, in which the brightness of phosphor screens is increased to required level and which are capable of showing high contrast images with pure colors, are required now.

SUMMARY OF THE INVENTION

The inventor of the present invention has studied to solve the above described problems of the conventional CRTs. As a result of the study, he found that indistinctness of outlines of images and lowering contrast are not related with a diameter of electron beam, but related with the scatter of light caused by phosphor particles in a phosphor screen. Lights are scattered in the phosphor screen without reference to brightness of the phosphor screen, but the eyes can watch images with adjusting the scatter of light. Therefore, means for preventing the scatter has not been regarded as important. When light intensities are lower than a threshold value, the eyes cannot distinguish a difference of light intensities in weak and high lights. Thus, by reducing intensities of scattered lights to proper values lower than said threshold value, the brightness of the phosphor screen can be experientially adjusted so as to show images with the highest contrast. However, this cannot solve substantively, so quality of images on the phosphor screen is inferior to that of printed images. To highly improve the quality of images on the phosphor screen, the problems of the phosphor screen should be substantively solved on the basis of optical theories.

The phosphor particles of the phosphor screen are fine particles and have optical characteristics of crystals. The crystals have lack of symmetry and have the large index of refraction, so that the phosphor particles have remarkably large index of refraction. For instance, a host crystal of typical blue and green phosphors is zinc sulfide (ZnS). Refraction index of zinc sulfide is 2.39, comparable with 2.42 of diamond. A host crystal of red phosphor is yttrium oxysulfide ($Y_2O_2S$). Although there is no available data of refraction index of $Y_2O_2S$, it is empirically known that $Y_2O_2S$ also has a high index of refraction, comparable with that of ZnS. When a light irradiates a phosphor particle, about 40% of the incident light reflects on a surface of the particle; 60% of the light penetrates into the particle. In the phosphor screen of the CRT, 10 billion phosphor particles are randomly arranged. Therefore, incident lights into the phosphor screen reflect on surfaces of a large number of the particles, so that the reflected lights are well randomized the directions as scattered lights in the phosphor screen.

The inventor further found that the incident visible lights into the phosphor particle repeat internal reflection therein and gets out therefrom because the phosphor particle do not have absorption band of visible lights. The lights, which get out from the particle, repeat reflection and penetration on surfaces of neighbor phosphor particles. Therefore, a spreading distance of the lights emitting in the phosphor screen is emphasized. The lights, which have emitted in the phosphor screen, reach the eyes of the viewer after the spreading distance is emphasized, so that the phosphor screen can give a wide viewing angle of images.

The scattered lights spread horizontally and vertically in the phosphor screen. The lights horizontally spread fade images on the phosphor screen and increase background brightness. Fading images and increasing background brightness make images unclear.

An object of the present invention is to provide a phosphor screen and a cathodoluminescence, which are capable of minimizing the spread of lights in the phosphor screen, so as to restrict fading images and lowering contrast.

To achieve the objects, the present invention ha s following structures. Namely, the phosphor screen of the present invention comprises a lot of minute phosphor sections, wherein the phosphor sections are respectively enclosed by barriers, which absorb visible lights and have electric conductance, and whose height is equal to or higher than a half of thickness of the phosphor sections, and the barriers are made of a material including the particles of an inorganic compound, whose average diameter is 1–8 $\mu$m, and carbon particles, whose average diameter is less than 1 $\mu$m.

With this structure, the scattered lights from the phosphor section do not badly influence the neighbor, so that highly clear images can be shown on the phosphor screen. Since the electrically conductive barriers collect secondary electrons, images can be shown without flicker. Preferably, the barriers are integrated with black matrices. With this structure, influence of the scattered lights to the neighbor phosphor sections can be further restricted.

Preferably, the inorganic compound is yttrium oxysulfide, aluminum oxide, titanium dioxide or zinc sulfide. By employing said compound, a physically stable state can be maintained even in a heat process of producing the cathodoluminescence, in which temperature will rise to about 450° C. By reusing used particles, a manufacturing cost of the cathodoluminescence can be reduced.

Preferably, the barrier material includes 0.05–20 wt % of carbon particles. By employing the barrier material, amount of gasses released from the barriers to a high vacuum space can be reduced, flicker can be removed, and sharpness and contrast of images can be improved. Note that, the phosphor sections may be made with color phosphor particles or monochrome phosphor particles.

Further, the cathodoluminescence of the present invention comprises:

a faceplate;

a phosphor screen being formed on the faceplate; and a cathode and an anode for irradiating an electron beam, which makes phosphor particles constituting the phosphor screen emit lights, wherein the phosphor screen comprises minute phosphor sections, the phosphor sections are respectively enclosed by barriers, which absorb visible lights and have electric conductance, and whose height is equal to or higher than a half of thickness of the phosphor sections, and the barriers are made of a material including particles of an inorganic compound, whose average diameter is 1–8 $\mu$m, and carbon particles, whose average diameter is less than 1 $\mu$m. With this structure, highly clear images can be shown on the phosphor screen without generating flicker. The cathodoluminescence can be used for a display device capable of showing high brightness and highly clear images.

The spreading distance of the lights in the phosphor screen change with number of layers of the phosphor particles in the screen and average mean free path. The spreading of lights is widened with an increase in the number of layers of the phosphor particles. Even if the number of layers is not changed, in the case that packing density of the phosphor particles is low, the average mean free path of the scattered lights is long. Therefore, the spread distance is made longer. In the case that the phosphor particles are fully packed, an penetration distance of electrons is quite shorter than the diameter of the phosphor particle; only the phosphor particles in a first layer, shown from an electron gun, emit lights. Other phosphor particles provided between the phosphor particles emitting lights and a faceplate do not work for illuminating the screen, but work for spreading or scattering lights. If one layer of the phosphor particles are arranged on the faceplate, no phosphor particles, which scatters lights without emitting lights, exist in the phosphor screen, so that the spread of the scattered lights in the phosphor screen can be minimized. However, in the case of forming one layer of the phosphor particles, there are gaps between adjacent phosphor particles; an electron beam often directly irradiate the faceplate via the gaps. The electron beams directly irradiating the faceplate does not work for illuminating the screen, so that the brightness of the phosphor screen is quite lowered. To maximize the brightness of the phosphor screen, the phosphor particles should be packed as no gaps are seen from the electron gun. According to the book of Cathodoluminescence (page 116, chapter 7.1.5, published by Kodansha, 1990), the spreading of scattered lights is minimized with 1.4 layers of the phosphor particles.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings. In the following description, CRTs will be explained as the cathodoluminescence, but the cathodoluminescence is not limited to the CRTs. The present invention may be applied to other devices, e.g., FEDs.

There are two kinds of CRTs: one is monochrome CRTs, and the other is color CRTs. Firstly, the monochrome CRT, whose phosphor screen has a simple structure, will be explained. The monochrome CRT of the present invention is shown in FIG. 3.

Figure 1:
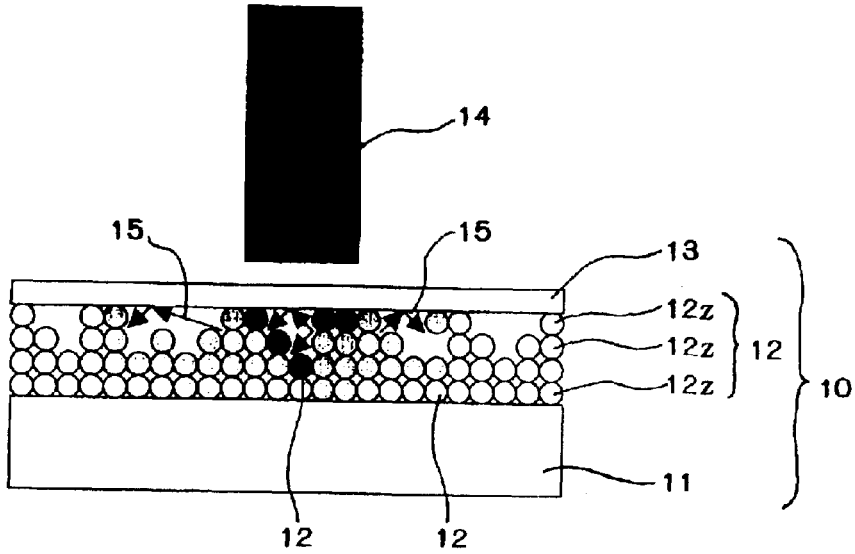
FIG.1 PRIOR ART
FIG. 1 is a partial sectional view of a conventional monochrome phosphor screen.
Figure 2:
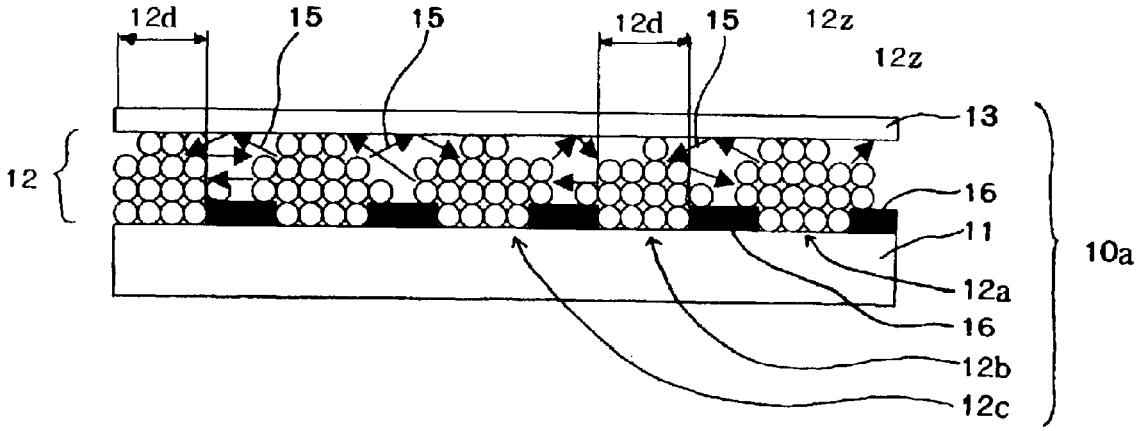
FIG.2 PRIOR ART
FIG. 2 is a partial sectional view of a conventional color phosphor screen.
Figure 3:
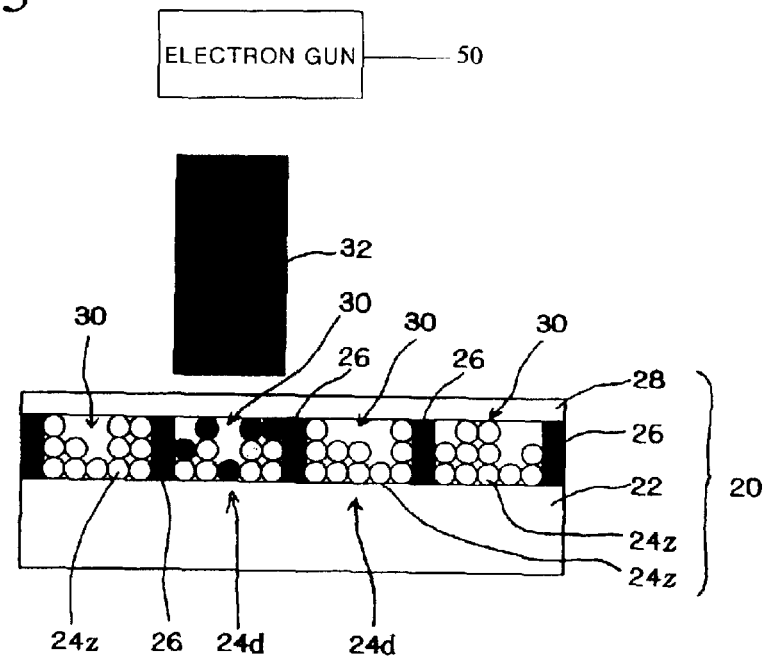
FIG. 3 is an explanation view of a monochrome CRT of an embodiment of the present invention.

In FIG. 3, a display section 20 of the CRT includes: a faceplate 22; a phosphor screen 24 constituted by phosphor particles 24*z* and formed on the faceplate 22; barriers 26 parting the adjacent minute phosphor sections 30, in each of which the phosphor particles 24*z* are packed; and an aluminum film 28 coating the phosphor screen 24. In the embodiments, the minute phosphor sections 30, each of which is a space enclosed by the faceplate 22, the barriers 26 and the aluminum film 28, act as phosphor pixels. An electron beam 32 is irradiated from an electron gun 50. The phosphor screen 24 comprises a lot of minute phosphor pixels 30.

In the phosphor screen 24 shown in FIG. 3, scattered lights are caged in each phosphor pixel 30. By caging the scattered lights, no scattered lights will be transmitted to neighbor phosphor pixels 30 without reference to brightness of the phosphor pixel 30. Since the scattered lights are caged in one phosphor pixel 30, background brightness of the phosphor pixel 30 has no relation with inner brightness of the phosphor pixel 30. Even if the brightness of the phosphor pixel 30 becomes high, phosphor particles 24*z* in the adjacent phosphor pixel 30 do not emit lights, so that fading images shown on the display section 20 can be removed, contrast of images can be improved due to high brightness of the phosphor pixels 30 and quality of images shown on the display section 20 of the monochrome CRT can be equal to that of photographs or printed images.

To cage the scattered lights in the phosphor pixels 30, each phosphor pixels 30 is surrounded by barriers 26, which absorb visible lights. Upon reaching the barriers 26, the scattered lights are absorbed by the barriers 26, so that they are not transmitted to the neighbor phosphor pixels 30. Height of the barrier 30 may be equal to a half of thickness of the phosphor screen 24, preferably it is equal to or slightly higher than the thickness of the phosphor screen 24. In the preferable case, the scattered lights can be effectively caged in the phosphor pixels 30. However, if the height of the barriers 26 is much higher than the thickness of the phosphor screen 24, it is difficult to form the phosphor screen 24.

A preferable material of the barriers 26 absorbs visible lights, so black bodies usually used for forming the barriers 26. The materials for the barriers 26 should be stable in a heat process of CRT production, and they do not discharge gasses in high vacuum spaces of CRTs. Organic materials do not fit the criteria, and only inorganic materials respond to the criteria.

Further, the preferable materials have electric conductance. Since the electrically conductive barriers 26 surrounding the phosphor pixels 30 are mutually connected on the faceplate 22, they are electrically connected as a conductive barrier mesh. When the barrier mesh is connected to an anode, the barriers 26, which uniformly cover the entire faceplate 22, have uniform anode potential, so that a strong anode field can be applied to the phosphor particles 24*z* on the entire faceplate 22. The phosphor pixel 30, to which the electron beam 32 irradiates, emits secondary electrons. The secondary electrons staying on surfaces of the phosphor particles 24*z* under the strong anode field are efficiently collected by the anode barriers 26; the rest secondary electrons are accelerated by the anode and reenter the phosphor particles 24*z*. Therefore, all of the secondary electrons on the surfaces of the phosphor particles 24*a* are removed, and flickers of images can be removed. Preferably, the materials of the barriers 26 is not oxidized in the heat process of CRT production, or oxides of the materials have electric conductance. One of the preferable materials is carbon particles, e.g., graphite particles. Of course, the preferable material is not limited to graphite particles. For example, in the case of a single color phosphor screen 24, colored inorganic compounds, which absorb prescribed color lights only and which have electric conductance, may be used.

If the size of the phosphor pixel 30 is equal to or greater than the diameter of the electron beam 32, resolution of the phosphor screen is defined by combination of the phosphor pixels 30, so that the resolution is improperly limited. To show sharp images, the size of the phosphor pixels 30 should be smaller than the diameter of the electron beam 32. If two pixels 30 are included in the diameter of the electron beam 32, the resolution of images is 3/2 times of the diameter of the electron beam 32. If three pixels 30 are included in the diameter of the electron beam 32, the resolution of images is 4/3 times of the diameter of the electron beam 32. Generally, the resolution of images on the phosphor screen is given by a formula:

$$\text{Resolution}=(\text{Beam Diameter})\times(1+1/n)$$

Where n is given by the number of the pixels 30 included in the electron beam 32.

Shape of the phosphor pixels 30 is not limited to a circular shape, it may be a square shape, a rectangular shape, etc. Any shapes may be used as far as proper resolution is gained.

Figure 4:
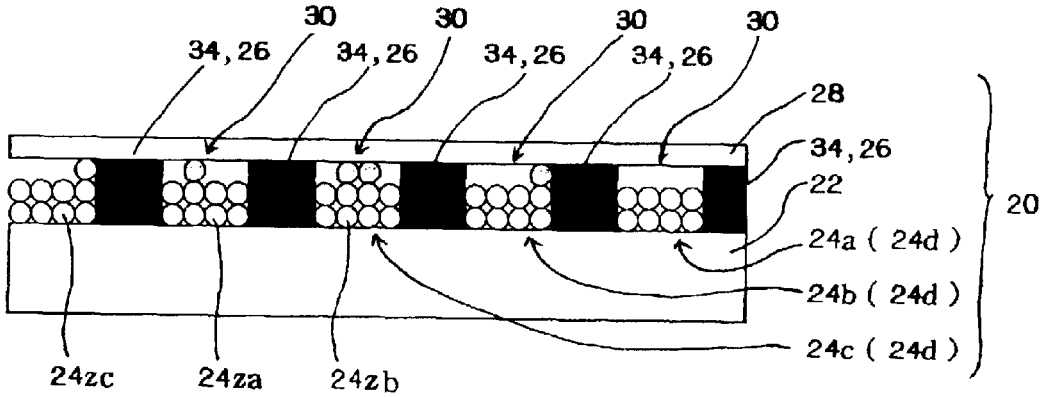
FIG. 4 is an explanation view of a color phosphor screen of another embodiment.
Figure 5A:
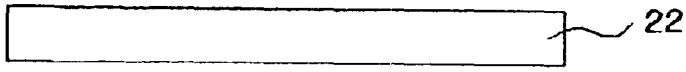
FIGS. 5A–5F are explanation views showing the steps of manufacturing a phosphor screen.
Figure 5B:
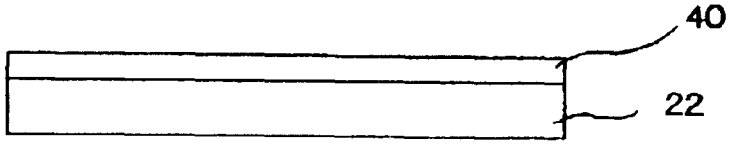
Figure 5C:
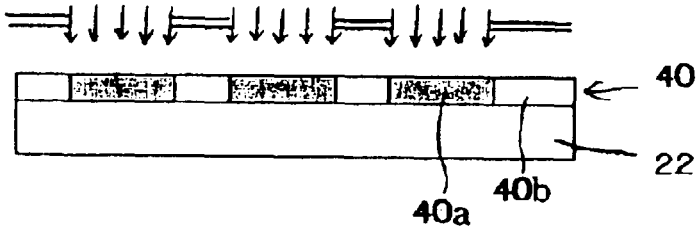
Figure 5D:
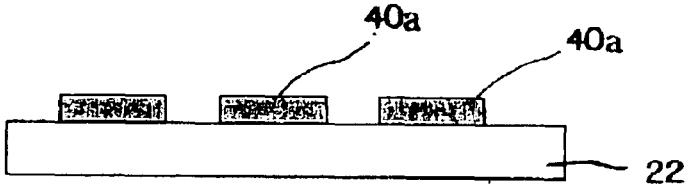
Figure 5E:
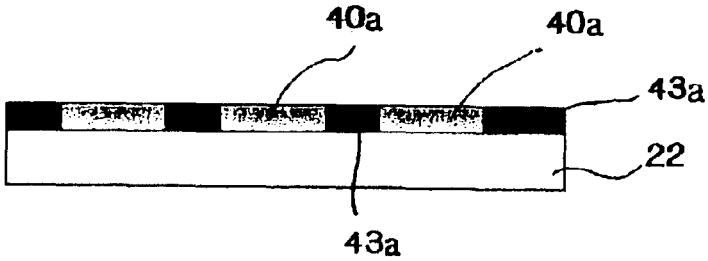
Figure 5F:
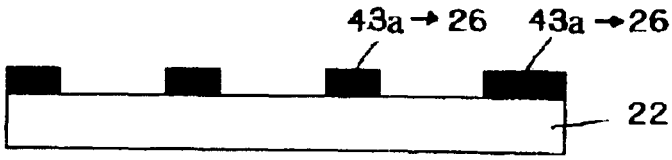

FIG. 4 is an explanation view of a color phosphor screen of another embodiment. Note that, elements explained in the foregoing embodiment (see FIG. 3) are assigned the same symbols and explanation will be omitted. In the display section of the color CRT, height of black matrices 34 is equal to or higher than that of the phosphor screen 24. The black matrices 34 surround the phosphor pixels 30 as the barriers 26, so that scattered lights can be caged in each phosphor pixel 30. Since the phosphor screen 24 of the color CRT emits lights of full visible range, the barriers 26 are made of a black material capable of absorbing all visible lights. The materials for the barriers 26 should be stable in a heat process of CRT production, and they do not discharge gasses in high vacuum spaces of CRTs. Organic materials do not fit the criteria, and only inorganic materials respond to the criteria. Further, the preferable materials have electric conductance. By having the electric conductance, a required amount of secondary electrons are collected by the anode barriers 26; the rest secondary electrons are accelerated by the anode and reenter phosphor particles. Therefore, flickers of images can be removed. For example, graphite particles may be used as a preferable inorganic material. Of course, the preferable material is not limited to graphite particles. For example, in the case of a single color phosphor screen 24, colored inorganic compounds, which absorb prescribed color lights only and which have electric conductance, may be used.

The color phosphor screen 24 includes a lot of triads, each of which is constituted by three phosphor pixels 30 respectively emitting a red light, a green light and a blue light. Sharpness of images are determined by sizes of the triads. The size of each triad is usually smaller than the diameter of the electron beam 32. The resolution of images on the color phosphor screen 24 is also given by above described formula. Generally, diameter of the triads is ⅓ of the diameter of the electron beam 32. Arrangement of the phosphor pixels 30 in each triad is not limited, circular arrangement, delta arrangement, etc. may be employed as far as proper resolution is gained.

If the barriers 26 are made of a film constituted by carbon particles and its height is made equal to or higher than the thickness of the phosphor screen 24, gasses discharged from the thick carbon barriers 26 must be discharged from the phosphor pixels 30. This problem can be solved by making the carbon film 26 thin. To form the thin carbon barriers 26, the barriers 26 are made of inorganic particles; which are similar to the phosphor particles 24*z*, and surfaces of the inorganic particles are uniformly coated with fine carbon particles. The inorganic particles and the fine carbon particles are mixed by, for example, a dry or wet ball mill so as to coat the surfaces of the inorganic particles. Diameter of the carbon particles is less than 1 $\mu$m; diameter of the inorganic particles is several $\mu$m. Therefore, the carbon particles coat the surfaces of the inorganic particles by mixing. For example, Aquadac (trade name), which is often used for CRT production, may be used as the fine carbon particles. Thickness of the carbon particles coating the surfaces of the inorganic particles can be controlled by mixture ratio thereof. Light absorption coefficient of the mixed particles is equal to that of carbon, and the mixed particles have high electric conductivity. The problem of discharged gasses in a high vacuum space can be solved by the barriers 26 made of the mixed particles.

The inorganic particles should be chemically stable in the air and physically stable in a heat process of producing the CRT, in which temperature will rise to about 450° C. By reusing used particles, a manufacturing cost of CRTs can be reduced. Since carbons in the used particles can be removed by heating at a temperature of 600–700° C., the inorganic particles should be stable at temperature higher than burning of carbon. The inorganic particles are slightly etched with an inorganic acid so as to clean their surfaces, so they preferably have small solubility with respect to inorganic acids. Preferable materials of the inorganic particles are yttrium oxysulfide, aluminum oxide, titanium dioxide, etc. Further, zinc sulfide may be employed as an inexpensive material. Although an adequate mixing ratio of the fine carbon particles and the inorganic particles changes with sizes and shapes of the particles, a good result is obtained with the mixing ration of the carbon particles below 20 Wt %. A preferable mixing ratio of the carbon particles is 0.05–10 Wt %; a more preferable ratio is 0.1–3 Wt %. The mixed particles having said mixing rate are formed like slurry so as to form the barriers 26 of the phosphor pixels 30 on the faceplate 22. The black matrices 34 are formed with a conventional method, except for the height or thickness thereof. After the barriers 26 are dried, the surface of the faceplate 22 is coated with the phosphor particles 24*z*. Further, the phosphor pixels 30, each of which is surrounded by the barriers 30, is filled with the phosphor particles 24*z* by photolithography. By filling the phosphor particles 24*z*, the phosphor pixels 30 are completed.

The CRT is usually manufactured by the steps of: forming the phosphor pixels 30, each of which is surrounded by the barriers 26 capable of absorbing lights and having electric conductance, on the entire faceplate 22; sealing the faceplate 22 and a funnel with flit glass; and mounting an electron gun to an end of a neck glass tube. When the CRT is used under operating conditions for NTSC video receivers or monitors of personal computers, bright, sharp and flickerless images can be shown at the distinct distance. Fine images like as pictures printed on sheets of paper or developed on medical film can be displayed on the monochrome phosphor screen. Further, the color CRT displays spectrally pure color images on the color phosphor screen at the high screen brightness, as well as distinguishably fine images on the color phosphor screen, like as color print pictures.

EXAMPLE 1

There are two kinds of CRTs: one is monochrome CRTs, and the other is color CRTs. They are manufactured by the steps of:

(1) forming the barriers on the faceplate;

(2) screening the phosphor particles in the barriers;

(3) forming the aluminum film on the phosphor screen;

(4) sealing the faceplate and the funnel with flit glass;

(5) mounting the electron gun in the neck glass tube;

(6) evacuating a CRT envelope; and (7) completing the CRT.

The step of forming the barriers 26 is common for the both kinds of CRTs, and the steps (2)–(7) are equal to those of the conventional CRT production method. Therefore, the step of forming the barriers 26 will be explained in detail with reference to FIGS. 5A–5F.

Firstly, a polyvinyl alcohol (PVA) resin film 40, which is a negative pattern of the barriers 26 and whose thickness is equal to a half of thickness of the phosphor screen 24 or more, is formed on the faceplate 22. The thickness of the PVA film 40 for forming the barriers 26 is, for example, about 5 $\mu$m. If the face plate is a flat glass plate, a printing technology is applicable to screen the thick PVA film 40. Because the faceplate 22 of the CRT is a curved glass plate, the printing technology cannot apply to form the PVA film 40 on the faceplate 22. Spin screening technology is applicable to form the PVA film 40. The PVA film 40 may be formed by coating the faceplate 22 with aqua solution of PVA, but it is difficult to control the thickness of the PVA film 40. In the present example, the diameter of the inorganic particles is equal to that of the phosphor particles 24*z*. PVA slurry 42, which is a mixture of the both particles and PVA, screens the faceplate 22. The PVA slurry 42 includes yttrium oxysulfide ($Y_2O_2S$) powders, but other inorganic compound powders may be used instead of yttrium oxysulfide powders.

Composition of the PVA slurry 42 for forming the barriers 26 is shown in TABLE 1.

TABLE 1

| Items | Weight ratio |
|---|---|
| Powders of $Y_2O_2S$ | 5 |
| Pure Water | 10 |
| PVA solution (7 Wt %) | 60 |
| ADC solution (2 Wt %) | 4 |

Weight ratio of the PVA slurry 42 is not limited to TABLE 1, other PVA slurry having different weight ratio may be employed. If the weight ratio of yttrium oxysulfide is increased, spreading exposed patterns and cutting the film will be worse.

A method of manufacturing the barriers 26 will be explained with reference to FIGS. 5A–5F.

Firstly, the PVA slurry 42 of TABLE 1 is prepared. The slurry 42 screens on the 14 inch faceplate 22 (see FIG. 5A) with using a spin coating facility with the rotation speed of 150 rpm for 30 seconds. After dry of the PVA slurry 42, the slurry 42 becomes the PVA film 40 (see FIG. 5B). The PVA film 40 is exposed with UV lights, which pass through aperture of a shadow mask (see FIG. 5C). Then, the exposed PVA film 40 is developed, so that parts 40*a* of the PVA film 40, which have been exposed, are left on the faceplate 22. On the other hands, non-exposed parts of the PVA film 40 are removed. The left parts 40*a* of the PVA film 40 become a negative pattern of the barriers 26 surrounding the phosphor pixels 30 (see FIG. 5D).

The material of the barriers 26 will be explained. In the present example, the 100 grams of yttrium oxysulfide powders, 5 grams of colloidal graphite and 10 grams of pure water are mixed to make a paste. The paste is dried in an oven heated at 90° C. The dried paste is ground or ball-milled. Lumps of the paste are sifted out from the milled powders with a 100 mesh sieve. The powders passed through the sieve are yttrium oxysulfide particles whose surfaces are coated with graphite powders. Slurry 43 is prepared by mixing 20 grams of the yttrium oxysulfide particles with graphite, 40 grams of pure water and 0.01 gram of potassium silicate solution. The slurry 43 screens on the faceplate 22, on which the negative pattern of the barriers 26 has been formed, with using the spin coating facility with the rotation speed of 250 rpm so as to fill spaces in the negative pattern with the slurry 43. After dry, particles 43*a* coated with graphite can be produced. Then, the faceplate 22 is developed with an oxidizing agent, e.g., permanganic acid solution, hydrogen peroxide solution, so that oxidized parts of the PVA film 40, which forms the negative pattern, are removed from the faceplate 22. After the faceplate 22 is washed with water, only the barriers 26, which are made of the particles 43*a* coated with graphite, are left. After dry of the faceplate 22, the phosphor particles 24*z* is applied to coat the faceplate 22, then ordinary steps of the CRT production will be executed. After said steps, the CRT having the phosphor screen 24, whose phosphor pixels 30 are surrounded by the barriers 26, is completed.

The barriers 26 may be formed, with the slurry 43, by following steps. Firstly, yttrium oxysulfide particles are directly put in colloid graphite solution. The suspension is well stirred, then the suspension screen on the face plate 22, on which the negative pattern of the barriers 26 has been formed. After dry, the faceplate 22 is developed with an oxidizing agent, only parts of the PVA film 40, which constitute the negative pattern, are oxidized and peeled from the faceplate 22. After the faceplate 22 is washed with water, only the barriers 26, which are made of the particles 43*a* coated with graphite, are left. The barriers 26 may be formed by above described steps too.

EXAMPLE 2

Example 2 will be explained with reference to FIG. 3.

In the present example, a monochrome CRT includes the faceplate 22 on which the barriers 26, which are made of particles 43*a* coated with graphite, are formed. Many white light-emitting phosphors are known. Among them, the yttrium oxysulfide phosphor activated with terbium (Tb) and europium (Eu) is the most suitable white light-emitting phosphor. TABLE 2 shows composition of PVA slurry of the present example.

TABLE 2

| Items | Weight ratio |
|---|---|
| $Y_2O_2S$:Tb:Eu phosphor powers | 20 |
| Pure Water | 10 |
| PVA solution (7 Wt %) | 20 |
| ADC solution (2 Wt %) | 2 |

PVA slurry 43, which includes the yttrium oxysulfide phosphors and PVA, is prepared with the mixture shown in TABLE 2. The slurry 43 screens on the faceplate 22, on which the barriers 26 have been formed, with using the spin coating facility. When the phosphor particles 24*z* are dried, the entire faceplate 22 is uniformly exposed with UV lights from a front side of the faceplate 22, which is opposite side of the screening side of the phosphor particles. The phosphor particles 24*z* inside of the barriers 26 are exposed, so that the exposed phosphor particles 24*z* adhere on the faceplate 22. Since the barriers 26 absorb the UV lights, the phosphor particles 24*z* on the barriers 26 are not exposed, so that they are not adhere on the faceplate 22. The exposed faceplate 22 is developed under ordinary conditions for the CRT production; the phosphor particles 24*z* surrounded by the black barriers 26 are left on the faceplate 22. The phosphor screen 24 is capable of displaying clear images. In the display section 20 of the present example, the aluminum film 28 is formed on the phosphor particles 24*z* by known technology so as to further increase the brightness of images. Then, known steps for the CRT production will be executed to complete the monochrome CRT of the present example.

In the monochrome CRT, the focus of the electron beam 32 can be dense by changing a focusing manner. The electron beam 32 is focused with two steps: prefocus and main focus. Electrodes for the prefocus are composed with a heater, a cathode, a first grid and a second grid. The electron beam 32 is extracted from the cathode, and the extracted beam 32 is weakly focused. In the step of main focus, the prefocused beam 32 is sharply focused on the display section 20 with desired diameter. There are two ways for main focus: electrostatic focus with many electrodes and magnetic focus used in electron microscopes. The magnetic focus is preferably used to sharply focus the electron beam 32 on the display section 20. In the monochrome CRT, anode voltage is fixed; if permanent magnets having no driving circuit are employed instead of electromagnets, the electron beam 32 can be sharply focused and consumption of electricity can be reduced. A deflection coil consumes a most large portion of an electric power of CRT operations. If the power consumption of the deflection coil is reduced, total power consumption of the CRT can be much reduced. Intensity of a magnetic field of the deflection coil for deflecting the electron beam 32 is determined by a distance between the electron beam 32 and the deflection coil. When the distance is made shorter, the intensity becomes greater. The distance between the electron beam 32 and the deflection coil is determined by a diameter of the neck tube. If the diameter is short, the power consumption of the deflection coil is small. Generally, the diameter of the neck tube is determined by a diameter of the electron gun 50 inserted in the neck tube. Since the ordinary diameter of the electron beam 32 is 0.5 mm or less, the diameter of the electron beam 32 is not influenced even if the diameter of the electron gun 50 is reduced to a few millimeters.

In the case of reducing diameters of electrodes for the prefocus, the diameter of the neck tube is not determined by the diameter of the electron gun 50 but a diameter of an exhausting tube for pumping of the CRT. By a consideration of the diameter of the exhausting tube, the diameter of the neck tube can be reduced to about 8 mm. A single electron gun 50 including the prefocus electrodes is attached to a front end of the neck tube. After this, ordinary steps for the CRT production will be executed. Namely, the CRT envelope is pumped to make highly vacuum condition therein; gasses are discharged; the cathode is activated; a getter is partially activated; the exhausting tube is melted to seal up the CRT; then the CRT is separated from an exhausting table. After the activation of the getter, an ordinary aging step is executed to complete the monochrome CRT. Two permanent magnetic rings are set on outer of the neck tube and fixed at a position for the best focus of the electron beam 32. When the monochrome CRT of the present example is operated with NTSC conditions or operating conditions of personal computers, the monochrome phosphor screen 24 displays distinct images with high contrast, and flickerless images at the distance of distinct vision even with high screen brightness. The quality of displayed images are comparable with printed images on sheets of graphic paper and further with images on medical films.

EXAMPLE 3

Example 3 will be explained with reference to FIG. 4.

A color CRT production has following characteristics: employing three types of phosphor particles 24*a*, which respectively emit the three primary colors; providing three electron guns for selectively irradiating the phosphor particles 24*z* so as to selectively emit lights of said colors; and providing a shadow mask. Other structures are equal to those of the monochrome CRT. In the present example, minute phosphor sections or pixels 24*d*, which respectively emit said colors and each of which is surrounded by the barriers 26, are formed on the faceplate 22 of the color CRT. A materials and a method of forming the barriers 26 of the present example are equal to those of the barriers of the monochrome CRT described above. The red phosphor particles 24*za* are applied, exposed and developed by ordinary manners, so that red phosphor pixels 24*a* surrounded by the barriers 26 are formed at prescribed positions on the faceplate 22. The green phosphor particles 24*zb* are applied, exposed and developed by ordinary manners, so that green phosphor pixels 24*b* surrounded by the barriers 26 are formed at prescribed positions on the faceplate 22. Finally, the blue phosphor particles 24*zc* are applied, exposed and developed by ordinary manners, so that blue phosphor pixels 24*c* surrounded by the barriers 26 are formed at prescribed positions on the faceplate 22, as well as the phosphor pixels 24*a* and 24*b*. By executing said steps, the faceplate 22 including the phosphor pixels, which emit the three primary colors and each of which is surrounded by the barriers 26 capable of absorbing scattered lights, can be formed. After this, ordinary steps for the color CRT production will be executed. Namely, the CRT envelope is pumped to make highly vacuum condition therein; gasses are discharged; the cathode is activated; the getter is partially activated; the exhausting tube is melted to seal up the CRT; then the CRT is separated from the exhausting table. After the activation of the getter, the ordinary aging step is executed to complete the color CRT. When the color CRT of the present example is operated with the NTSC conditions or the operating conditions of personal computers, the color phosphor screen displays distinct images with high contrast, and flickerless images at the distance of distinct vision even with high screen brightness. The quality of displayed images are comparable with printed images on sheets of graphic paper and further with images on medical films.

In the phosphor screen and the cathodeluminescence of the present invention, lights scattered in the phosphor screen can be caged in each minute phosphor sections, and a strong anode electric field can be applied to the phosphor particles in the phosphor screen. Therefore, flickers appearing on the entire screen and small flickers of images can be removed without reference to the brightness of the phosphor screen and frame cycles of pixels. Further, sharp and high contrast images, whose quality is almost equal to that of printed images on sheets of graphic paper and images on medical films. Especially, in the case of color screens, bright color images are not whitened, so high quality color images, which is comparable with color photographs, can be shown on the color screens.

The invention may be embodied in other specific forms without departing from the spirit or essential characteristics thereof. The present embodiments are therefore to be considered in all respects as illustrative and not restrictive, the scope of the invention being indicated by the appended claims rather than by he foregoing description and all changes which come within the meaning and range of equivalency of the claims are therefore intended to be embraced therein.

What is claimed is:

1. A phosphor screen of a cathodoluminescence, comprising:

a lot of minute phosphor sections, wherein said phosphor sections are respectively enclosed by barriers, which absorb visible lights and have electric conductance, and whose height is equal to or higher than a half of thickness of said phosphor sections, and said barriers are made of a material including the particles of an inorganic compound, whose average diameter is 1–8 $\mu$m, and carbon particles, whose average diameter is less than 1 $\mu$m.

2. The phosphor screen according to claim 1, wherein said barriers are integrated with black matrices.

3. The phosphor screen according to claim 1, wherein said inorganic compound is yttrium oxysulfide, aluminum oxide, titanium dioxide or zinc sulfide.

4. The phosphor screen according to claim 1, wherein said barrier material includes 0.05–20 wt % of carbon particles.

5. The phosphor screen according to claim 1, wherein said phosphor sections are made with color phosphor particles.

6. The phosphor screen according to claim 1, wherein said phosphor sections are made with monochrome phosphor particles.

7. A cathodoluminescence, comprising:

a faceplate;

a phosphor screen being formed on said faceplate; and a cathode and an anode for irradiating an electron beam, which makes phosphor particles constituting said phosphor screen emit lights, wherein said phosphor screen comprises minute phosphor sections, said phosphor sections are respectively enclosed by barriers, which absorb visible lights and have electric conductance, and whose height is equal to or higher than a half of thickness of said phosphor sections, and said barriers are made of a material including particles of an inorganic compound, whose average diameter is 1–8 $\mu$m, and carbon particles, whose average diameter is less than 1 $\mu$m.

8. A display device including the cathodoluminescence according to claim 7.

* * * * *